US006845222B2

(12) United States Patent
Takai

(10) Patent No.: US 6,845,222 B2
(45) Date of Patent: Jan. 18, 2005

(54) IMAGE FORMING METHOD AND IMAGE FORMING APPARATUS FOR SUPPRESSING MOVEMENT OF DEVELOPER ONTO THE ELECTROSTATIC LATENT IMAGE CARRIER WHEN THE VOLTAGES APPLIED TO THE CHARGING AND DEVELOPING DEVICES ARE RAISED OR LOWERED

(75) Inventor: Takayuki Takai, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/301,730

(22) Filed: Nov. 22, 2002

(65) Prior Publication Data

US 2004/0042813 A1 Mar. 4, 2004

(30) Foreign Application Priority Data

Aug. 28, 2002 (JP) ..... 2002-248292

(51) Int. Cl.[7] ..... G03G 15/00

(52) U.S. Cl. ..... 399/88; 399/50; 399/55; 399/89; 399/235

(58) Field of Search ..... 399/37, 46, 50, 399/53, 55, 88, 89, 90, 234, 235

(56) References Cited

U.S. PATENT DOCUMENTS 4,286,866 A * 9/1981 Stelben et al.
5,179,411 A * 1/1993 Yoshiuchi et al. ..... 399/46
5,864,733 A * 1/1999 Mae et al. ..... 399/46
2001/0024579 A1 9/2001 Onuki et al.

FOREIGN PATENT DOCUMENTS

JP 03012671 A * 1/1991 ..... G03G/15/00

OTHER PUBLICATIONS

Translation of JP03012671.*

* cited by examiner

*Primary Examiner*—Arthur T. Grimley
*Assistant Examiner*—Ryan Gleitz
(74) *Attorney, Agent, or Firm*—Morrison & Foerster LLP

(57) ABSTRACT

An electrophotographic image forming apparatus having a photosensitive member 1, a charging roller 2 and a developing roller 31, and including an output variable power source 8 common to the charging and the developing rollers 2 and 31 for applying voltages to the charging and developing rollers 2 and 31, respectively, a power source output control portion 9, and a voltage changing device (Zener diode D1) interposed between the developing roller 31 and the power source 8, wherein, when the voltages applied to the charging and developing rollers 2 and 31 are raised to and lowered from voltages required for image formation, respectively, the control portion 9 controls an output of the power source 8 to perform the raising and lowering of the applied voltages for a predetermined time while keeping a potential difference for suppressing movement of developer onto the photosensitive member 1 between the voltages applied to the charging and developing rollers 2 and 31.

5 Claims, 8 Drawing Sheets

IMAGE FORMING METHOD AND IMAGE FORMING APPARATUS FOR SUPPRESSING MOVEMENT OF DEVELOPER ONTO THE ELECTROSTATIC LATENT IMAGE CARRIER WHEN THE VOLTAGES APPLIED TO THE CHARGING AND DEVELOPING DEVICES ARE RAISED OR LOWERED

CROSS-REFERENCE TO RELATED APPLICATION

This application is based on Japanese patent application No. 2002-248292 filed in Japan on Aug. 28, 2002, the entire content of which is hereby incorporated by reference.

BACKGROUND OF THE INVENTION

1. Field of the Invention

The present invention relates to an electrophotographic image forming apparatus of a stand-alone type, a network type or the like for forming monochrome images and/or color images such as a copying machine, a printer, a facsimile machine or a composite machine including a combination of two or more of them.

2. Description of Related Art

The above kind of image forming apparatus in the prior art includes an electrostatic latent image carrier, a charging device and a developing device, and further includes a charging power source or supply for charging a surface of the electrostatic latent image carrier to a predetermined potential and a developing bias power source for applying a developing bias voltage to the developing device for developing an electrostatic latent image.

In this kind of image forming apparatus, the charging device to which a charging voltage is applied from the charging power source charges the surface of the electrostatic latent image carrier, and the electrostatic latent image is formed on a region thus charged, and is developed by the developing device to which the developing bias voltage is applied from the developing bias power source.

In the image forming apparatus such as a printer, it is now demanded to reduce the number of parts for providing a compact structure of the apparatus.

For satisfying this demand, the charging power source and the developing bias power source may be formed of a common power source.

However, the common power source serving as both the charging power source and the developing bias power source applies a charging voltage of a value for practical use in image formation to the charging device, and also applies the developing bias voltage of a value for practical use in image formation to the developing device when the voltages applied to the charging device and the developing device are raised.

As a result, developer moves onto the electrostatic latent image carrier when the voltages applied to the charging device and the developing device are raised so that the developer is wasted. The developer is likewise wasted when the voltages applied to the charging and developing devices are lowered.

For performing, e.g., reversal development of the electrostatic latent image with two-component developer containing carrier and negatively chargeable toner, the common power source applies the negative charging voltage of the value for practical use in the image formation to the charging device, and also applies the negative developing bias voltage of the value for practical use in the image formation when the voltages applied to the charging and developing devices are raised. Thereby, a surface region of the electrostatic latent image carrier, which is not yet charged by the charging device, reaches the developing device supplied with the developing bias voltage before a surface region of the electrostatic latent image carrier, which is charged by the charging device, reaches the developing device. Therefore, the negatively charged toner moves from the developing device onto this uncharged region. This wastes the toner.

When the voltages applied to the charging and developing devices are to be lowered, the common power source simultaneously stops the supply of voltages to the charging device and the developing device so that a surface region of the electrostatic latent image carrier, which is already negatively charged by the charging device, reaches the developing device, to which the voltage is not applied, and the positively charged carrier move onto this charged region from the developing device. This wastes the carrier.

For example, in an image forming apparatus, which perform reversal development of an electrostatic latent image with a one-component developer primarily made of negatively chargeable toner, negatively charged toner moves onto a region of the electrostatic latent image carrier, which is not yet charged, when the voltages applied to the charging and developing devices are raised so that the toner is wasted.

SUMMARY OF THE INVENTION

An object of the invention is to provide an image forming method, in which a charging device supplied with a charging voltage charges a surface of an electrostatic latent image carrier, image exposure is effected on a charged region of the surface of the electrostatic latent image carrier to form an electrostatic latent image, and a developing device supplied with a developing bias voltage develops the electrostatic latent image, and particularly to provide an image forming method, in which parts of an image forming apparatus can be reduced in number and consumption of developer can be suppressed.

Another object of the invention is to provide an image forming apparatus including an electrostatic latent image carrier, a charging device, a developing device and others for forming an image by charging a surface of the electrostatic latent image carrier by the charging device supplied with a charging voltage, effecting image exposure on a charged region of the surface of the electrostatic latent image carrier to form an electrostatic latent image, and developing the electrostatic latent image by the developing device supplied with a developing bias voltage, and particularly to provide an image forming apparatus, which allows reduction of the number of required parts, and can suppress consumption of developer.

The invention provides the following image forming methods and the following image forming apparatuses.

(1) Image Forming Method (1-1) First Image Forming Method

An image forming method for forming an image by charging a surface of an electrostatic latent image carrier by a charging device, to which a charging voltage is applied, effecting image exposure on a charged region of the surface of the electrostatic latent image carrier to form an electrostatic latent image, and developing the electrostatic latent image by a developing device, to which a developing bias voltage is applied, comprising:

employing an output variable power source common to the charging device and the developing device as a power source for applying the charging voltage to the charging device and a power source for applying the developing bias voltage to the developing device, and interposing a voltage changing device between the charging device and the common power source and/or between the developing device and the common power source; and controlling an output of the common power source, when the voltages applied to the charging and developing devices are raised to voltages required for image formation, respectively, and/or when the voltages applied to the charging and developing devices are lowered from the voltages required for the image formation, respectively, to perform the raising and/or the lowering of the applied voltages for a predetermined time while keeping a potential difference for suppressing movement of developer onto the electrostatic latent image carrier between the voltages applied to the charging and developing devices.

(1-2) Second Image Forming Method

An image forming method for forming an image by charging a surface of an electrostatic latent image carrier by a charging device, to which a charging voltage is applied, effecting image exposure on a charged region of the surface of the electrostatic latent image carrier to form an electrostatic latent image, and developing the electrostatic latent image by a developing device, to which a developing bias voltage is applied, comprising:

employing a power source common to the charging device and the developing device as a power source for applying the charging voltage to the charging device and a power source for applying the developing bias voltage to the developing device; and controlling an output of the power source, when the voltages applied to the charging and developing devices are raised to voltages required for image formation, respectively, and/or when the voltages applied to the charging and developing devices are lowered from the voltages required for the image formation, respectively, to perform the raising and/or the lowering of the applied voltages by changing the applied voltages stepwise while keeping a potential difference for suppressing movement of developer onto the electrostatic latent image carrier between the voltages applied to the charging and developing devices.

(2) Image Forming Apparatus

An image forming apparatus having an electrostatic latent image carrier, a charging device and a developing device for forming an image by charging a surface of the electrostatic latent image carrier by the charging device, to which a charging voltage is applied, effecting image exposure on a charged region of the surface of the electrostatic latent image carrier to form an electrostatic latent image, and developing the electrostatic latent image by the developing device, to which a developing bias voltage is applied, and comprising:

an output variable power source common to the charging device and the developing device for applying the charging voltage to the charging device and applying the developing bias voltage to the developing device;

a power source output control portion for controlling an output of the power source; and a voltage changing device interposed between the charging device and the power source and/or between the developing device and the power source, wherein when the voltages applied to the charging and developing devices are raised to voltages required for image formation, respectively, and/or when the voltages applied to the charging and developing devices are lowered from the voltages required for the image formation, respectively, the power source output control portion controls the output of the power source to perform the raising and/or the lowering of the applied voltages for a predetermined time while keeping a potential difference for suppressing movement of developer onto the electrostatic latent image carrier between the voltages applied to the charging and developing devices.

According to the image forming methods and the image forming apparatus described above, the power source common to the charging device and the developing device is employed as the power sources for applying the charging voltage and the developing bias voltage to the charging device and the developing device, respectively. Therefore, the parts in the image forming apparatus can be reduced in number, and therefore the image forming apparatus can have reduced sizes.

When the voltages applied to the charging and developing devices are raised to voltages required for image formation, respectively, and/or when the voltages applied to the charging and developing devices are lowered from the voltages required for the image formation, the output of the common power source is controlled to perform the raising and/or lowering of the applied voltages while keeping a potential difference for suppressing movement of developer onto the electrostatic latent image carrier between the voltages applied to the charging and developing devices.

Accordingly, it is possible to suppress wasting of the developer when raising and/or lowering the voltages applied to the charging and developing devices.

In the image forming apparatus, when the voltages applied to the charging and developing devices are lowered after completion of an image forming operation, full exposure may be effected on the surface of the electrostatic latent image carrier, and the electrostatic latent image carrier and the developing device may be stopped simultaneously with or after arrival of the fully exposed surface portion of the electrostatic latent image at a developing position opposed to the developing device.

The invention also provides the following image forming apparatus.

An image forming apparatus having an electrostatic latent image carrier, a charging device, a developing device and an image exposing device for forming an image by charging a surface of the electrostatic latent image carrier by the charging device, to which a charging voltage is applied, effecting image exposure by the image exposing device on a charged region of the surface of the electrostatic latent image carrier to form an electrostatic latent image, and developing the electrostatic latent image by the developing device, to which a developing bias voltage is applied, and comprising:

an output variable power source common to the charging device and the developing device for applying the charging voltage to the charging device and applying the developing bias voltage to the developing device;

a power source output control portion for controlling an output of the power source; and a voltage changing device interposed between the charging device and the power source and/or between the developing device and the power source, wherein when the voltages applied to the charging and developing devices are lowered after completion of an image forming operation, the image exposing device effects full exposure on the surface of the electrostatic latent image carrier, the power source output control portion stops the output from the power source simultaneously with arrival of the fully exposed surface portion of the electrostatic latent image carrier at a developing position opposed to the developing device, and the electrostatic latent image carrier stops simultaneously with the arrival, or after the arrival and before the fully exposed surface portion completely passes through the developing position.

According to this image forming apparatus, the fully exposed surface portion of the electrostatic latent image has a surface potential lowered nearly to a grand potential. Accordingly, the power source output control portion stops the output from the power source at the same time as this surface portion reaches the developing position opposed to the developing device, and thereby stops the voltage application to the developing device so that movement of the developer from the developing device onto the electrostatic latent image carrier is suppressed. Simultaneously with the stop of voltage application to the developing device, or after the stop of the voltage application and before completion of passing of the fully exposed surface portion through the developing position, and in other words, before a trailing portion, which may be charged in some cases depending on the manner of fully exposing processing, of the fully exposed portion of the electrostatic latent image carrier reaches the developing device, the electrostatic latent image carrier is stopped so that the movement of the developer from the developing device onto the electrostatic latent image carrier is suppressed. This suppresses wasting of the developer. For example, in reversal development with two-component developer, consumption of carrier can be suppressed.

In the above mentioned image forming apparatus, when the voltages applied to the charging and developing devices are raised to voltages required for image formation, respectively, the power source output control portion may control the power source output to perform the raising of the applied voltages for a predetermined time while keeping a potential difference for suppressing movement of the developer onto the electrostatic latent image carrier between the voltages applied to the charging and developing devices.

The invention can also achieve the following advantage. As compared with a structure including independent power sources for applying voltages to the charging device and the developing device, respectively, it is possible to reduce variations, which may occur in potential difference between an image background potential of the electrostatic latent image carrier and the voltage applied to the developing device when the image forming apparatuses are manufactured, so that designing of the developer and the developing system can be easy.

The invention can be applied to various kinds of electrophotographic image forming apparatuses of a stand-alone type, a network type or the like for forming monochrome images and/or color images such as a copying machine, a printer, a facsimile machine or a composite device including a combination of two or more of them.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the invention will now be described with reference to the drawings.

First Embodiment

Figure 1:
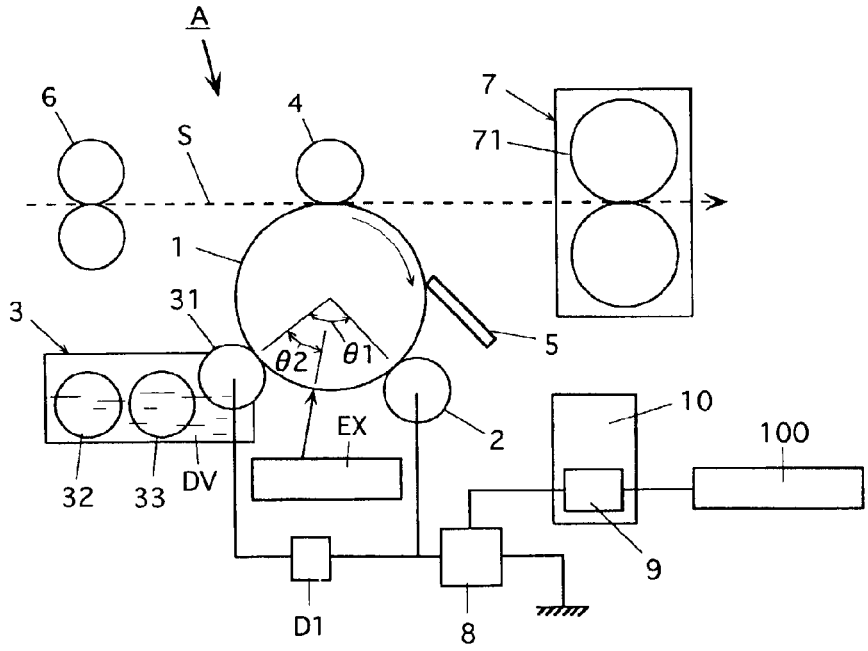
FIG. 1 shows a schematic structure of an image forming apparatus according to a first embodiment of the invention.

FIG. 1 shows a schematic structure of an electrophotographic image forming apparatus (printer) of a first embodiment of the invention.

An image forming apparatus A has a rotatable drum-like photosensitive member 1 serving as an electrostatic latent image carrier, and also includes a charging roller 2 serving as a charging device, a developing device 3, a transfer roller 4 serving as a transfer device, and a cleaning device 5 formed of a cleaning blade, which are arranged in this order around the photosensitive member 1. In FIG. 1, an image exposing device EX of a laser beam type is arranged under the photosensitive member 1. In FIG. 1, a timing roller pair 6 and a fixing device 7 are arranged on the left and right sides of the transfer roller 4, respectively.

The developing device 3 has a developing roller 31 opposed to the photosensitive member 1 as well as rotary members 32 and 33 for stirring and applying developer, and accommodates two-component developer DV containing a negatively chargeable toner and a magnetic carrier. The developing device 3 performs reversal development of an electrostatic latent image formed on the photosensitive member 1.

The fixing device 7 includes a fixing roller pair 71 for fixing a toner image onto a record member S by heat and pressure.

The image forming apparatus A further includes a high-voltage power source 8 providing a variable output and a power source output control portion 9 for controlling the output of the power source 8. The power source 8 is used commonly for applying a negative charging voltage to the charging roller 2 and for applying a developing bias voltage to the developing roller 31.

The power source 8 is connected to the charging roller 2, and is also connected to the developing roller 31 via a Zener diode D1, which is an example of a voltage changing device.

The control portion 9 is arranged in a controller 10 controlling operations of the image forming apparatus. The controller 10 receives signals for image formation from a portion 100 such as an external network or a computer, and controls the image forming apparatus to perform the image formation.

The image forming apparatus A forms an image basically in the following manner.

A drive device (not shown) drives the photosensitive member 1 to rotate clockwise, and the charging roller 2 supplied with the charging voltage from the common power source 8 charges a surface of the photosensitive member 1 to have a predetermined negative potential. The image exposing device EX effects image exposure on a region thus charged in accordance with an original image so that an electrostatic latent image is formed. The electrostatic latent image is developed into a visible toner image by the developing roller 31 supplied with the developing bias voltage from the common power source 8. This developing is performed by moving the charged toner onto the electrostatic latent image owing to an electric field, which is formed between the voltage applied to the developing roller 31 and the electrostatic latent image. The rotating photosensitive member 1 moves the toner image onto a transferring position, where the transfer roller 4 is opposed to the photosensitive member 1.

The record member (typically, a record paper sheet) S supplied from a record member supply device (not shown) reaches the timing roller pair 6. The timing roller pair 6 supplies the record member S to the transfer position in synchronization with the toner image on the photosensitive member 1. Prior to this, a transfer voltage is applied from a power source (not shown) to the transfer roller 4.

In this manner, the toner image is transferred onto the record member S, and then is fixed by the heat and pressure applied from the fixing device 7. Then, the record member S is discharged onto a discharge tray (not shown).

After the transfer of the toner image, the cleaning device 5 removes the developer remaining on the photosensitive member 1.

The apparatus A basically performs the image forming operation as described above. In the apparatus A, the voltages applied to the charging roller 2 and the developing roller 31 are raised and lowered as follows for suppressing waste of the developer.

When the voltages applied to the charging and developing rollers 2 and 31 are raised to intended voltages (i.e., the voltages to be practically used in the image formation) and/or when these voltages are lowered from the intended voltages, the power source output control portion 9 controls the output of the power source 8 to perform the raising and/or lowering of the applied voltages for a predetermined time while keeping a predetermined potential difference for suppressing movement of the developer onto the photosensitive member 1 between the voltage applied to the charging roller 2 and the voltage applied to the developing roller 31.

In this example, the above "predetermined potential difference" is equal to 800 V, and is kept by the voltage dropping function of the Zener diode D1.

The "predetermined time" is several times larger than a time T1, which is required for moving the region of the photosensitive member 1 charged by the charging roller 2 to a developing position opposed to the developing roller 31. The time T1 can be expressed by the following formula:

$$\text{Time } T1\ (sec.) = (\text{central angle } \theta 1\ (°)/360°) \times (L/Sp)$$

where the "L" is a photosensitive member peripheral length (mm) and the "Sp" is a photosensitive member peripheral speed (mm/sec.), and the central angle θ1 (°) is a central angle of the photosensitive member 1 formed between positions on the photosensitive member 1, which are opposed to the charging roller 2 and the developing roller 31, respectively.

Figure 2:
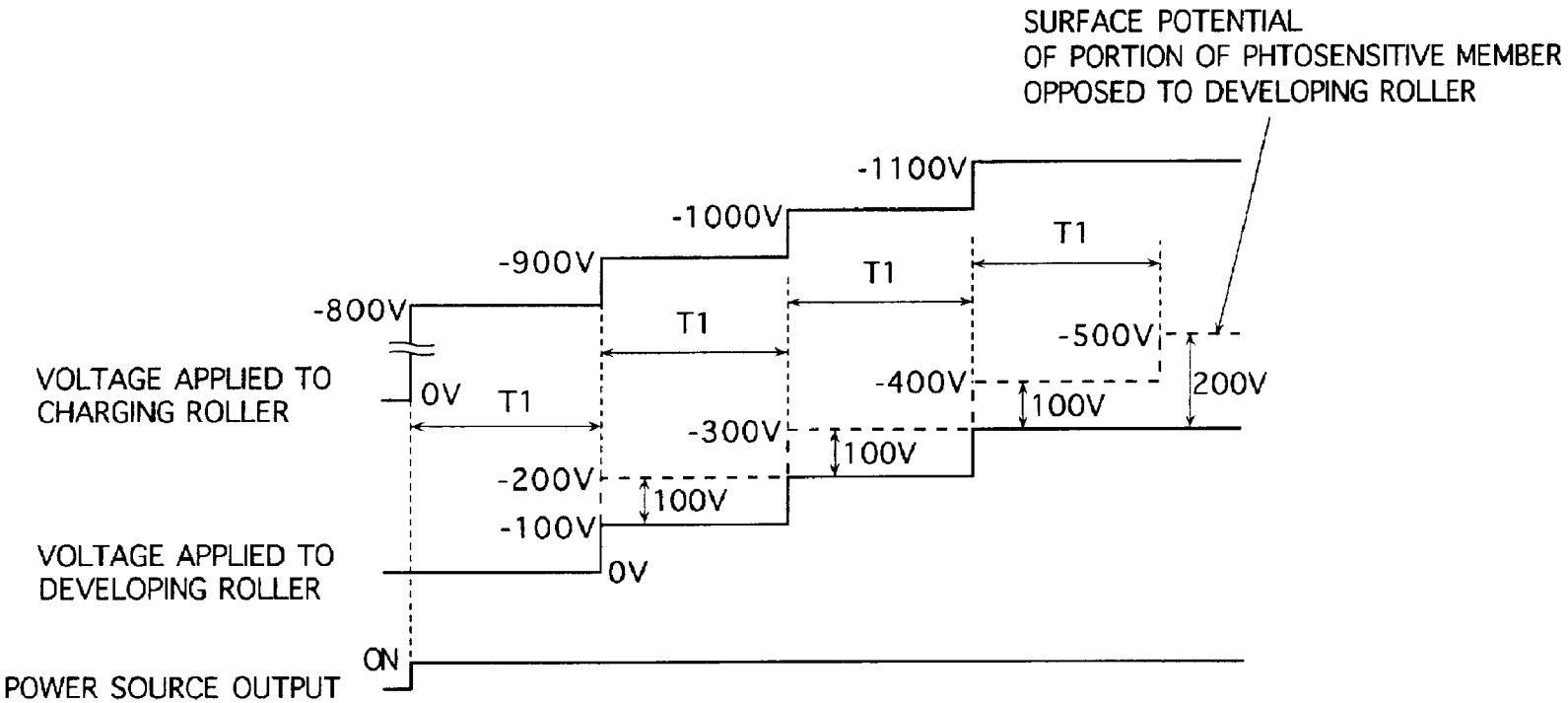
FIG. 2 illustrates, by way of example, raising of voltages applied to a charging roller and a developing roller in the image forming apparatus shown in FIG. 1.
Figure 3:
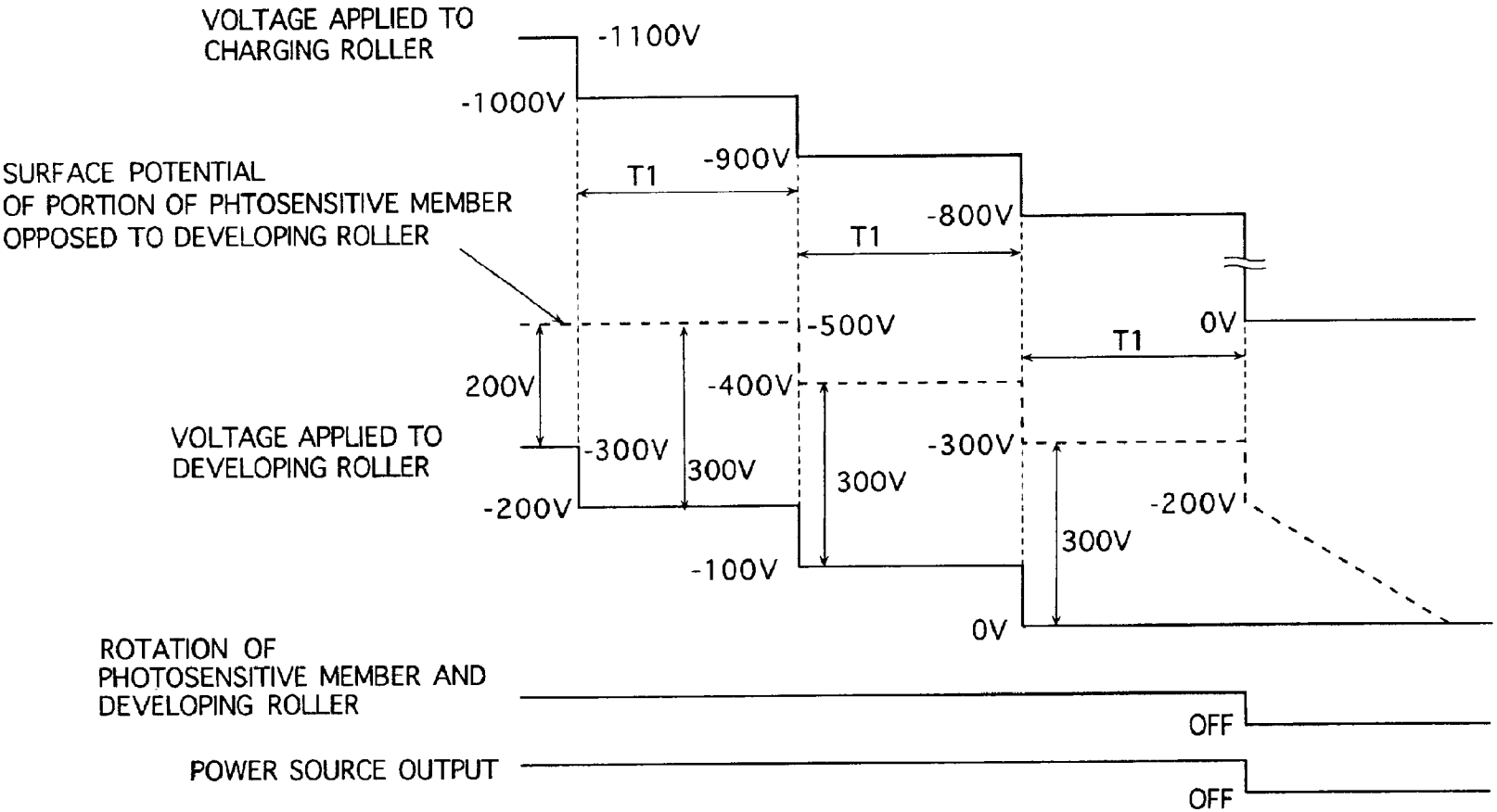
FIG. 3 illustrates, by way of example, lowering of the voltages applied to the charging roller and the developing roller in the image forming apparatus shown in FIG. 1.

FIG. 2 illustrates an example of rising of the voltages, which are applied to the charging and developing rollers 2 and 31, respectively. FIG. 3 illustrates an example of falling of the voltages applied to the charging and developing rollers 2 and 31.

In the image forming operation, as shown in FIG. 2, the charging voltage of −1100 V is applied to the charging roller 2, and the photosensitive member 1 has the surface potential (i.e., potential on the background of the image) of −500 V. By the image exposure, the surface potential of the photosensitive member 1 falls to −50 V, and a potential difference of 250 V is present between this surface potential and the developing bias voltage of −300 V applied to the developing roller 31, and serves a developing potential difference for forming the developing electric field.

The potential difference between the background potential of the photosensitive member 1 and the voltage applied to the developing roller 31 is equal to 200 V in this example. In general, it is desired that the potential difference between the background potential of the photosensitive member 1 and the voltage applied to the developing roller 31 is equal to 200 V or about 200 V. If this potential difference were lower than 50 V, fogging would occur due to movement of weakly charged toner onto the photosensitive member 1. If the above difference were higher than 400 V, the carrier would be consumed. These conditions are described merely by way of example, and are variable depending on system structures such as a kind of the developer, a developing manner and a charging manner, system setting conditions such as a distance between the photosensitive member 1 and the developing roller 31, the number of printed sheets, an operation environment and others.

When the controller 10 issues a print start instruction, the photosensitive member 1 starts the rotation to prepare for printing. Under the control of the control portion 9, the high voltage power source 8 starts the voltage supply to the charging and developing rollers 2 and 31. The charging roller 2 is supplied with the voltage of −800 V. The developing roller 31 is supplied with the voltage of 0 V, which is dropped by 800 V in absolute value through the Zener diode D1. Before the region of the photosensitive member 1, which was charged by the charging roller 2 opposed thereto, reaches the developing position in accordance with the rotation of the photosensitive member 1, the surface portion of the photosensitive member 1 opposed to the developing roller 31 carries the potential of 0 V, and the developing potential difference is 0 V so that the developer does not move onto the photosensitive member 1.

Upon elapsing of the foregoing time T1 from the start of the voltage application to the charging and developing rollers 2 and 31, the voltages applied to the charging and developing rollers 2 and 31 are changed to −900 V and −100V, respectively. The voltage, which is applied to the developing roller 31 from the common power source 8 through the Zener diode D1, changes while keeping a predetermined potential difference of 800 V with respect to the voltage applied to the charging roller 2. In this state, the potential of the surface portion of the photosensitive member 1 opposed to the developing roller 31 is already raised to −200 V, and an electric field in the non-developing direction is formed by the potential difference of 100 V with respect to the developing roller 31 so that the developer does not move onto the photosensitive member.

Thereafter, the control portion 9 operates to increase the power supply voltage by a raising step value of 100 V upon every elapsing of the time T1 so that the voltages applied to the charging roller 2 and the developing roller 31 will reach values of −1100 V and −300 V to be practically used for image formation, respectively. Thereafter, the image forming operation starts.

The raising step value is not restricted to 100 V, and may be set to another value depending on the image forming process.

After completion of the image forming operation, an ending operation is performed. As shown in FIG. 3, the voltages applied to the charging and developing rollers 2 and 31 are changed from the values of −1100 V and −300V for practical use in the image forming operation to −1000 V and −200 V, respectively.

The voltage applied to the developing roller 31 from the common power source 8 through the Zener diode D1 changes while keeping the potential difference of 800 V with respect to the voltage applied to the charging roller 2. In this operation, the voltage of −500 V is kept on the surface portion of the photosensitive member 1 opposed to the developing roller 31, and the electric field in the non-developing direction is formed with respect to the developing roller 31 by the potential difference of 300 V so that the developer does not move onto the photosensitive member.

Upon elapsing of the time T1 from start of the change of the voltages applied to the charging and developing rollers 2 and 31, the voltages applied to the charging and developing rollers 2 and 31 are changed to −900 V and −100V, respectively. In this operation, the surface portion of the photosensitive member 1 opposed to the developing roller 31 attains the potential of −400 V when the time T1 elapses, and therefore the potential difference of 300 V is kept with respect to the developing roller 31.

Thereafter, the applied voltages are likewise changed by a dropping step value of 100 V upon every elapsing of the time T1. After the voltage applied to the charging roller 2 attains −800 V and the potential on the surface portion of the photosensitive member 1 opposed to the developing roller 31 attains about −200 V, the power source 8 stops the voltage application, and the photosensitive member 1 and the developing roller 31 stop the rotation.

The foregoing dropping step value is not restricted to 100 V. The dropping step value may be set to another value in accordance with the image formation process.

The voltages, which are applied to the charging roller 2 immediately after the raising and immediately before the stop of power supply, respectively, are not restricted to −800 V. These voltages can be set to other values depending on the image forming process.

The time required for one step is not restricted to the time T1. However, it is desirable that the time for one step is equal to or longer than the time T1, and is equal to or shorter than a time required for one rotation of the photosensitive member if the photosensitive member 1 of the drum type or another photosensitive member of a rotary type such as an endless belt type is employed.

In the image forming apparatus A described above, the voltages applied to the charging and developing rollers 2 and 31 are changed at both the times of raising and lowering of these voltages. However, the applied voltages may be changed only at the time of raising or at the time of lowering. Even if the applied voltage is changed only at the time of raising or lowering, this can suppress the waste of the developer. If the applied voltage is to be changed only at the time of raising or lowering, this change may be performed at the time of lowering because the carrier is wasted at the time of lowering, and refilling of the carrier is troublesome.

If a developing device using, e.g., one-component developer, which is primarily made of negatively chargeable toner, performs the reversal development of the electrostatic latent image, the applied voltages may be changed at the time of raising because the toner is wasted at the time of raising.

Various portions of the image forming apparatus A are not restricted to those already described.

The control portion 9 may be independent of the controller 10, and may be arranged outside the image forming apparatus.

The image exposing device EX is not restricted to the laser beam type, and may be selected from various types using an LED array or the like.

As already described, the one-component developer may be used, and correspondingly a one-component developing device may be used. The developing manner is not restricted to the reversal developing.

The electrostatic latent image carrier is not restricted to the drum type, and may be of a belt type or the like.

The charging device is not restricted to the roller charging type. The charging device may be a charger of a Corona discharging type, or may employ a charging member such as a blade, a brush or the like. If the charger of the Corona discharging type having a grid is employed, the charging voltage may be applied to the grid. If the charger employs the charging member such as a blade, a brush or the like, the voltage may be applied to the charging member.

The transfer device may employ a transfer charger, a transfer belt or the like instead of the transfer roller. In stead of the direct transfer type, in which the toner is directly transferred from the photosensitive member or another electrostatic latent image carrier onto the record member, the transfer may be performed through two or more steps in such a manner that a toner image is transferred onto an intermediate transfer member such as an intermediate transfer roller or an intermediate transfer belt, which is arranged between the electrostatic latent image carrier and the record member, and then is transferred from the intermediate transfer member onto the record member.

Instead of the cleaning blade, the cleaning device may employ a cleaning brush, a cleaning roller or the like. The cleaning device may be of a composite cleaning type employing a combination of two or more of such members. Alternatively, the cleaning device may be eliminated, and a cleanerless type, in which the developing device collects untransferred toner, may be employed.

Instead of the fixing roller pair described above, the fixing may be performed in another manner employing a fixing belt or the like, in a non-contact manner or the like.

Instead of the Zener diode, the voltage changing device may employ another voltage changing means such as a varistor or another voltage changing element.

The voltage changing device may be arranged on the side of the charging device instead of the developing device, or may be on each of the sides of the charging device and the developing device.

The foregoing matters relating to the modifications may be applied to image forming apparatuses of other embodiments, which will be described hereinafter.

Second Embodiment

Figure 4:
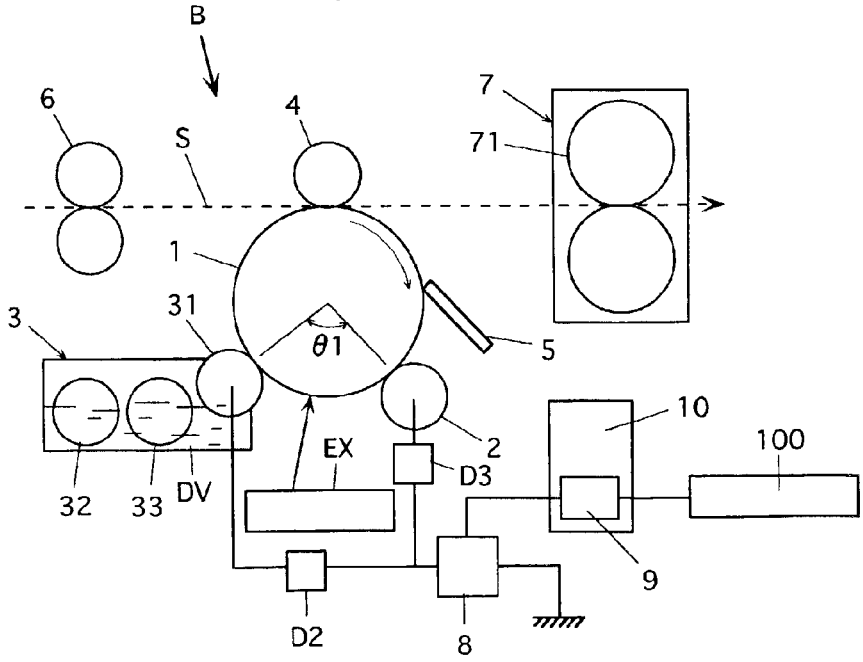
FIG. 4 shows a schematic structure of an image forming apparatus according to another embodiment of the invention.

FIG. 4 shows a schematic structure of an image forming apparatus B of a second embodiment.

The apparatus B differs from the apparatus A shown in FIG. 1 in that a Zener diode D2 lowering a voltage by 700 V is employed as the voltage changing device instead of the Zener diode D1, and a voltage changing element D3 raising a voltage by 100 V is connected between the power source 8 and the charging roller 2. The image forming apparatus B has the same structure as the apparatus A except for the above, and performs the image forming operation basically in the same manner as the apparatus A. The same parts as those in the apparatus A bear the same reference numbers or symbols.

In the image forming apparatus B, when the voltages applied to the charging and developing rollers 2 and 31 are to be raised, the control portion 9 controls the power source 8 to start the supply of the voltages of −700 V, to raise the applied voltages by 100 V upon every elapsing of the time T1 and to supply finally the voltages of −1100 V and −300V to the charging and developing rollers 2 and 31, respectively.

When the voltages applied to the charging and developing rollers 2 and 31 are to be lowered, the control portion 9 controls the power source 8 to lower stepwise the applied voltages by 100 V at a time from −1100 V, and to stop finally the supply of the voltages to the charging and developing rollers 2 and 31.

Similarly to the image forming apparatus A, the image forming apparatus B can suppress the waste of developer.

In the apparatus B, the voltage changing device is arranged on each of the sides of the charging device and the developing device, whereby the common power source for applying the voltages to the charging device and the developing device may be utilized for another device while allowing adjustment of the output of the power source in accordance with the device other than the charging and developing devices.

Third Embodiment

Figure 5:
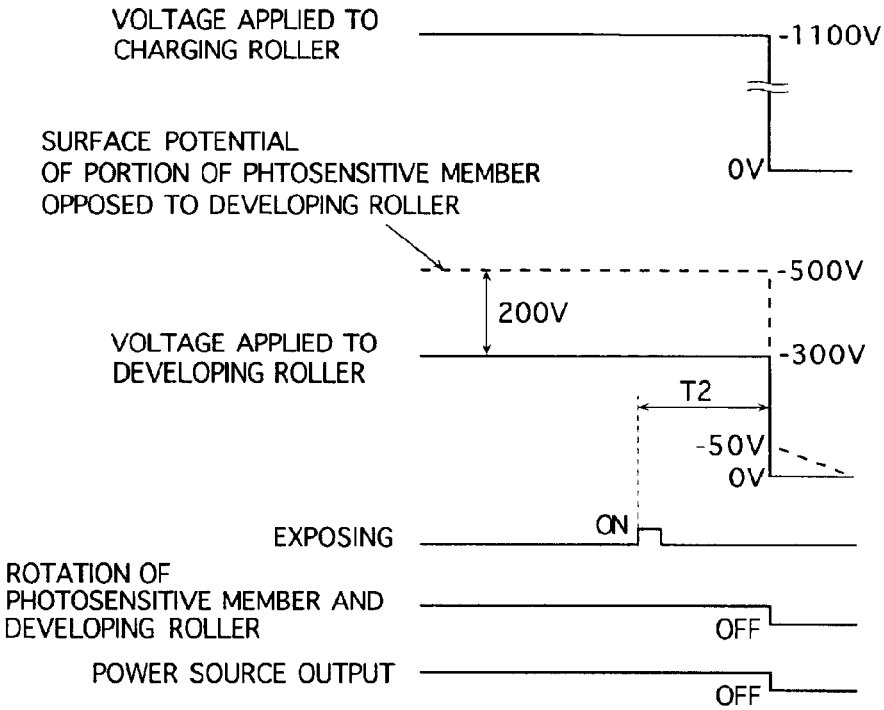
FIG. 5 illustrates another example of lowering of the voltages applied to the charging and developing rollers.

An image forming apparatus of a third embodiment has basically the same structure as the image forming apparatus A shown in FIG. 1, and performs the image formation basically in the same manner as the apparatus A. The voltages applied to the charging and developing rollers 2 and 31 are raised as illustrated in FIG. 2. However, the voltages applied to the charging and developing rollers 2 and 31 are lowered as illustrated in FIG. 5. Thus, the control portion 9 controls the output of the power source 8 to perform the lowering as illustrated in FIG. 5.

As illustrated in FIG. 5, the ending operation starts after completion of the image forming operation.

In this ending operation, a surface portion of the photosensitive member 1, and particularly the surface portion extending across the surface traveling direction is fully exposed to the full exposing light of the image exposing device EX. A time T2 is required before the fully exposed surface portion of the photosensitive member 1 reaches the developing roller 31 after the start of the full exposing. The power source 8 stops the supply to the charging and developing rollers 2 and 31 upon elapsing of the time T2. At the same time, or before the fully exposed portion of the photosensitive member 1 passes through the position opposed to the developing roller 31, the photosensitive member 1 and the developing roller 31 stops the rotation.

The photosensitive member portion having the surface potential, which was lowered substantially to the ground potential by the full light-emission exposure, has moved to the position opposed to the developing roller 31 when the time T2 elapses, and the developer does not move onto the photosensitive member. Before the fully exposed portion of the photosensitive member 1 entirely passes through the position opposed to the developing roller 31, and thus before the photosensitive member surface portion, which follows the fully exposed portion and is still in the charged state, reaches the developing roller 31, the photosensitive member 1 stops the rotation so that the developer does not move onto the photosensitive member.

The time T2 is expressed by the following formula:

$$\text{Time } T2(sec.)=(\text{central angle } \theta 2(^\circ)/360^\circ)\times(L/Sp)$$

where the "L" is a photosensitive member peripheral length (mm) and the "Sp" is a photosensitive member peripheral speed (mm/sec.), and the central angle θ2(°) is a central angle between the image exposing position on the photosensitive member 1 and the position opposed to the developing roller 31 (see FIG. 1).

Fourth Embodiment

Figure 6:
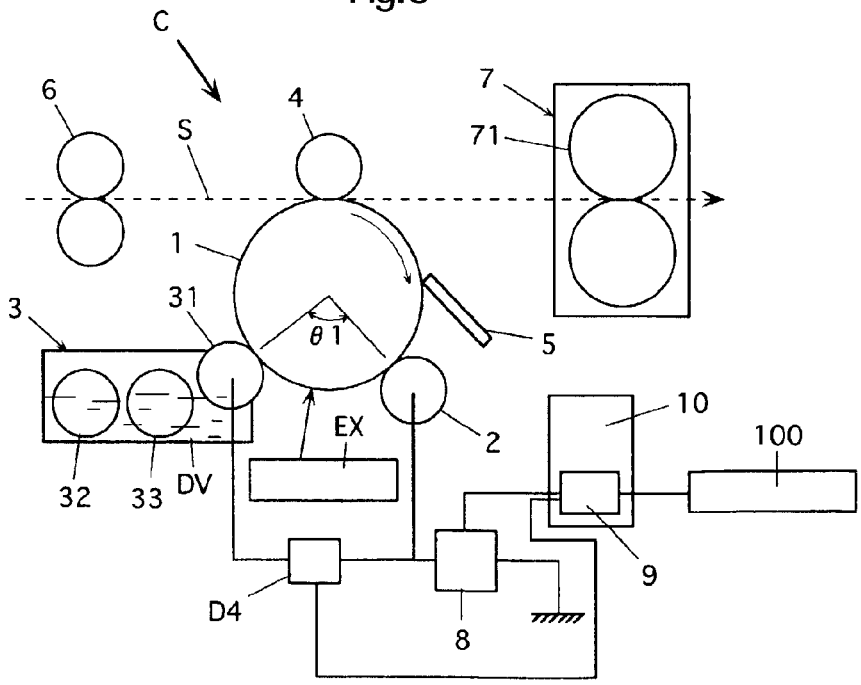
FIG. 6 shows a schematic structure of an image forming apparatus according to still another embodiment of the invention.

FIG. 6 shows a schematic structure of an image forming apparatus C of a fourth embodiment.

The image forming apparatus C differs from the image forming apparatus A shown in FIG. 1 in that a voltage changing device D4, which can change the output voltage in multiple steps, is employed instead of the Zener diode D1, which is the voltage changing device in FIG. 1 so that the control portion 9 can change the output value of the voltage changing device D4 when it changes the output of power source 8.

The image forming apparatus C has the same structure as the apparatus A except for the above, and performs the image forming operation basically in the same manner as the apparatus A. The same parts as those in the apparatus A bear the same reference numbers or symbols.

In the image forming apparatus C, a large potential difference is provided between the voltages applied to the charging and developing rollers 2 and 31, respectively, immediately after the raising of the voltages applied to the charging and developing rollers 2 and 31, and thereafter this potential difference is reduced to attain the voltages for the image formation.

The image forming apparatus C is basically configured as follows. The voltage changing device, which is connected between the output variable power source common to the charging and developing devices and the developing device, can perform voltage transformation in two or more steps, and the power source output control portion controls the output of the power source and the output of the voltage changing device to raise stepwise the voltages applied to the charging and developing devices such that a potential difference of ΔV occurs between the voltage applied to the charging device and the voltage applied to developing device immediately after start of the voltage application to the charging and developing devices, and thereafter the potential difference becomes smaller than the value of ΔV.

According to the image forming apparatus C, a uniform potential difference can be maintained between the surface potential of the portion of the photosensitive member 1 opposed to the developing roller 31 and the voltage applied to the developing roller 31 after start of the voltage application to the charging and developing rollers 2 and 31. In this embodiment providing the potential difference, which is uniform and thus does not increase, the developer can be selected from more kinds of developer.

For example, a particle diameter of toner has recently been decreased for a higher image quality. For this, a carrier must have a reduced particle diameter corresponding to a reduced toner particle diameter. In general, if the toner has a reduced particle diameter, the potential difference between the surface potential of the photosensitive member and the voltage applied to the developing roller must fall within a narrow range for suppressing adhesion of the developer onto the photosensitive member. According to the charging characteristics of the toner and carrier, an excessively small potential difference causes fogging of the toner, and an excessively large potential difference causes carrier adhesion. Only the potential difference falling within the narrow range can prevent both the toner fogging and the carrier adhesion. By providing the uniform potential difference in this embodiment, the developer having the above features can be utilized easily.

When lowering the voltages, the outputs of the power source and the voltage changing device are controlled such that the potential difference between the voltages applied to the charging and developing rollers 2 and 31 may be smaller than the potential difference at the time of image formation.

Figure 7:
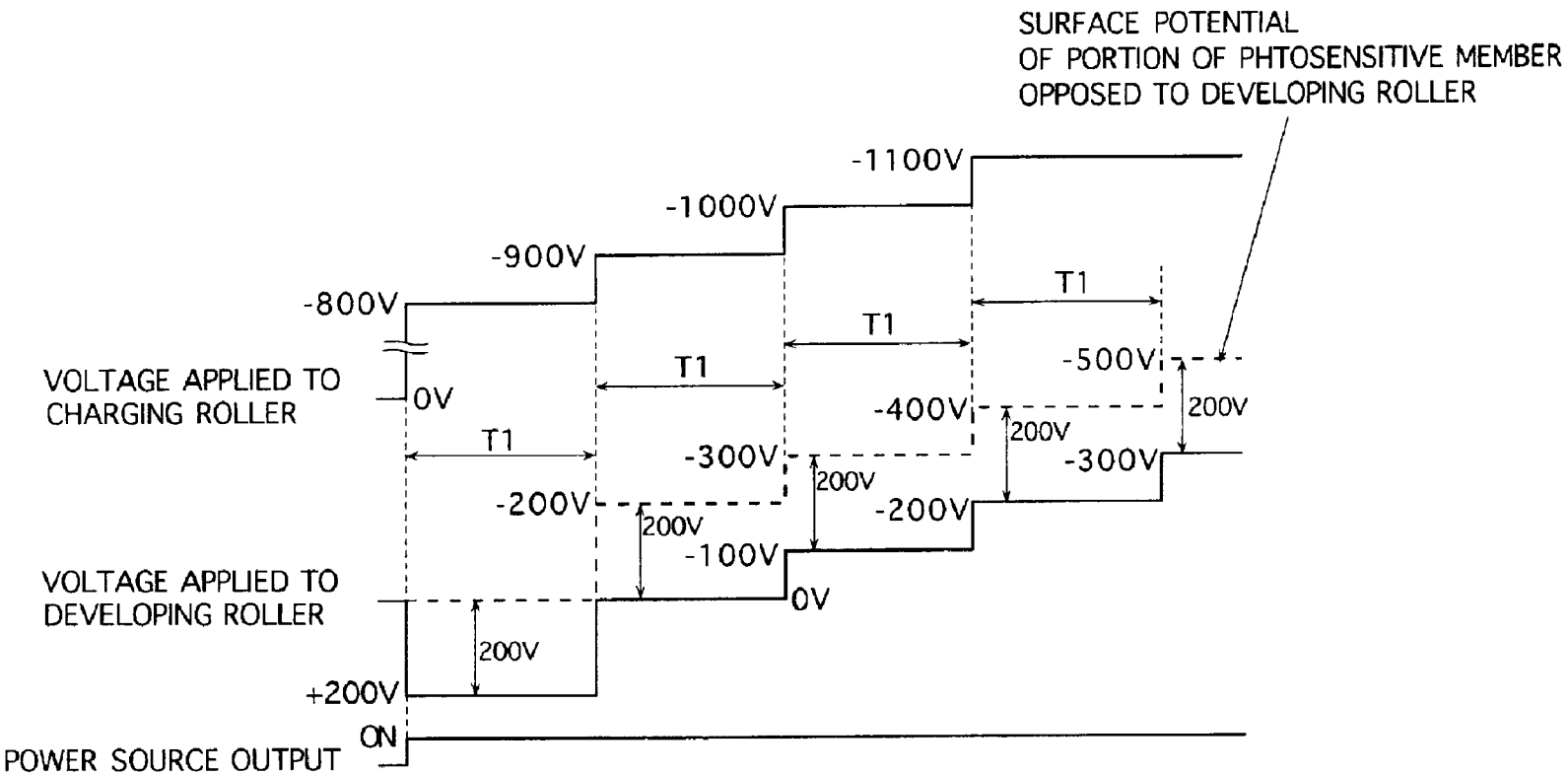
FIG. 7 illustrates, by way of example, raising of voltages applied to a charging roller and a developing roller in the image forming apparatus shown in FIG. 6.
Figure 8:
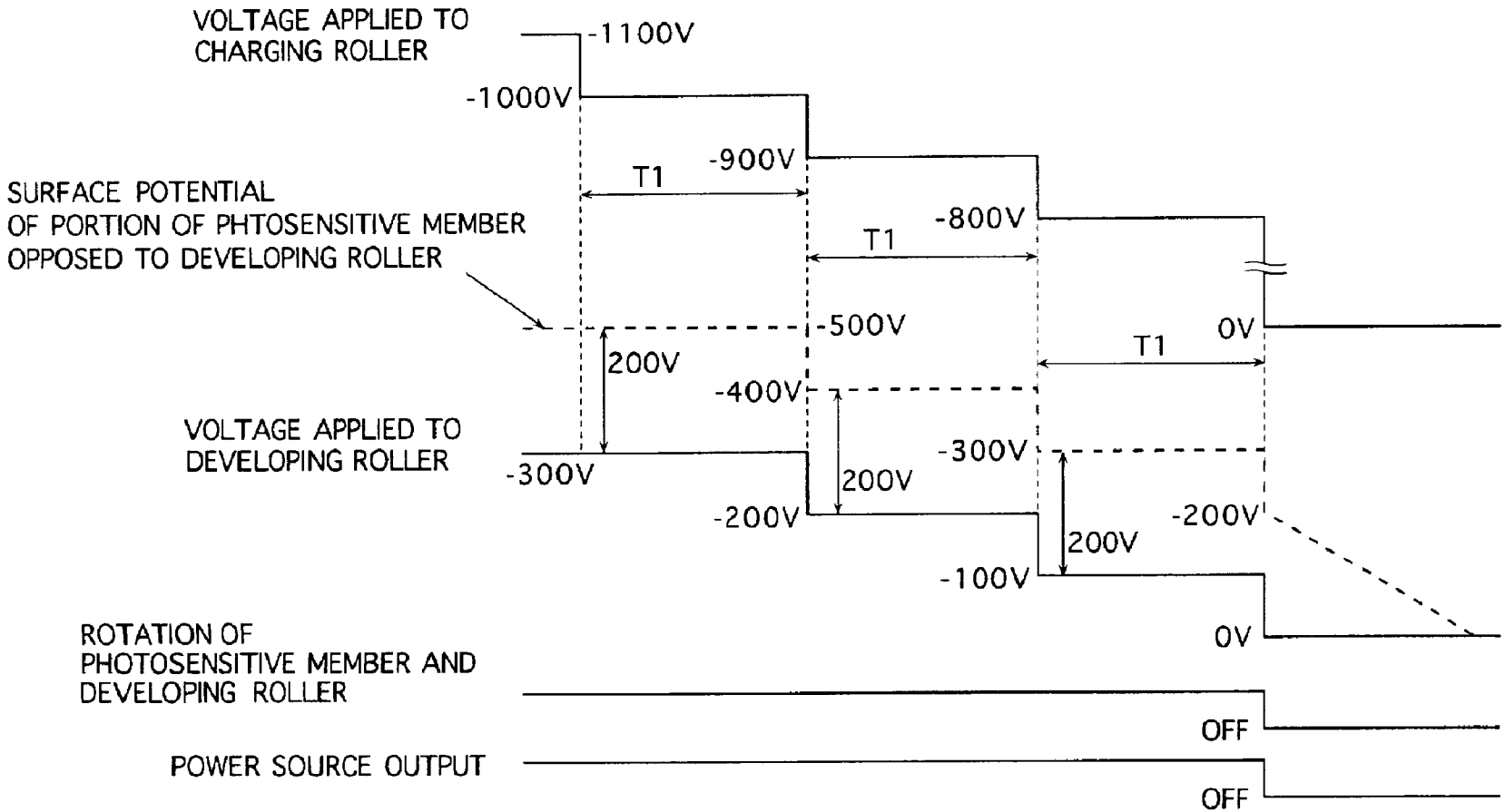
FIG. 8 illustrates, by way of example, lowering of the voltages applied to the charging and developing rollers in the image forming apparatus shown in FIG. 6.

FIG. 7 illustrates an example of the raising in the image forming apparatus C, and FIG. 8 illustrates an example of the lowering.

As shown in FIG. 7, when the controller 10 issues the print start instruction, the photosensitive member 1 starts the rotation to prepare for printing.

The power source 8 starts the voltage application to the charging and developing rollers 2 and 31 so that the charging and developing rollers 2 and 31 are supplied with the voltages of −800 V and +200 V, respectively. A first potential difference of 1000 V is present between the voltage applied to the charging roller 2 and the voltage applied to the developing roller 31 from the common power source 8 through the voltage changing device D4. Before the region of the photosensitive member 1 opposed to and charged by the charging roller 2 reaches the developing position in accordance with the rotation of the photosensitive member 1, the surface portion of the photosensitive member 1 opposed to the developing roller 31 bears the potential of 0 V, and an electric field in the non-developing direction is formed by the potential difference of 200 V with respect to the developing roller 31 so that the developer does not move onto the photosensitive member 1.

When a time equal to the time T1 elapses after the start of voltage application to the charging and developing rollers 2 and 31, the voltages applied to the charging and developing rollers 2 and 31 are changed to −900 V and 0 V, respectively. In this operation, the difference between the voltages applied to the charging and developing rollers 2 and 31 is changed to a second potential difference of 900 V smaller than the first potential difference. The portion of the photosensitive member 1 opposed to the developing roller has the surface potential raised to −200 V, and a potential difference of 200 V is kept with respect to the developing roller 31.

Thereafter, the voltages applied to the charging and developing rollers 2 and 31 are increased by 100 V upon every elapsing of the time T1 while maintaining the second potential difference of 900 V. During the above operation, the potential difference of 200 V is kept between the developing roller 31 and the surface portion of the photosensitive member 1 opposed to the developing roller 31.

The change of the power source output is repeated to attain the surface potential of −500 V for the image formation on the photosensitive member 1. Thereafter, the voltage applied to the developing roller 31 is changed to the value of −300 V to be practically used in the image formation, and the potential difference between the voltages applied to the charging and developing rollers 2 and 31 is changed to a third potential difference of 800 V. Then, the image forming operation starts.

The first to third potential differences are not restricted to the foregoing values, and may be set to other values depending on the image forming process.

After completion of the image forming operation, the ending operation is performed.

As shown in FIG. 8, the voltage applied to the charging roller 2 is changed from the value of −1100 for practical use in the image formation to −1000 V while maintaining the voltage applied to the developing roller 31 at the value of −300 V for practical use in the image formation. Thereby, the potential difference between the voltages applied to the charging and developing rollers 2 and 31 is changed to a fourth potential difference of 700 V. At this point in time, the surface portion of the photosensitive member 1 opposed to the developing roller 31 maintains the surface potential of −500 V attained during the image formation, and an electric field in the non-developing direction is formed by the potential difference of 200 V with respect to the developing roller 31 so that the developer does not move onto the photosensitive member 1.

Upon elapsing of the time T1 from the start of change of the voltage applied to the charging roller 2, the voltages applied to the charging and developing rollers 2 and 31 are changed to −900 V and −200 V, respectively. At this point in time, the fourth potential difference of 700 V is maintained between the voltages applied to the charging and developing rollers 2 and 31. The surface portion of the photosensitive member 1 opposed to the developing device 31 attains −400 V after the time T1, and the potential difference of 200 V is maintained with respect to the voltage applied to the developing roller 31.

Thereafter, the voltage is lowered by 100 V upon every elapsing of the time T1 while maintaining the fourth potential difference of 700 V. Thereby, the voltage applied to the charging roller 2 is lowered to −800 V. Also, the surface portion of the photosensitive member 1 opposed to the developing roller 31 substantially reaches −200 V. Thereafter, the power source 8 stops the voltage supply in accordance with the instruction sent from the control portion 9, and the photosensitive member 1 and the developing roller 31 stop the rotation.

The potential differences at the time of voltage lowering are not restricted to the above values.

The voltage, which is initially applied to the charging roller 2 in the rasing operation, and the voltage applied to the charging roller 2 immediately before the stop of voltage application are not restricted to the foregoing value of −800 V. These values can be set to other values in accordance with the image formation process.

In the raising and/or lowering operations, the time for one step is not restricted to the foregoing time T1, and can be set to another value depending on the image formation process. However, it is desired that the time for one step is equal to or longer than the time T1, and does not exceed a time required for one rotation of the photosensitive member 1.

Fifth Embodiment

In the image forming apparatuses already described, the raising and lowering of the voltages applied to the charging and developing devices are performed stepwise. However, the raising and lowering are not restricted to this manner. The raising and lowering may be performed continuously, e.g., in a stepless (analog) manner or a micro-stepwise manner (with an extremely narrow step interval).

If the applied voltages are to be changed (i.e., raised and/or lowered) continuously, the output variable power source 8, e.g., in the image forming apparatus A in FIG. 1 may have a variable resistance, and the power source output control portion 9 may be configured to control and change the resistance value of the variable resistance continuously. The means and manner for continuously changing the power source output are not restricted to the above.

Figure 9:
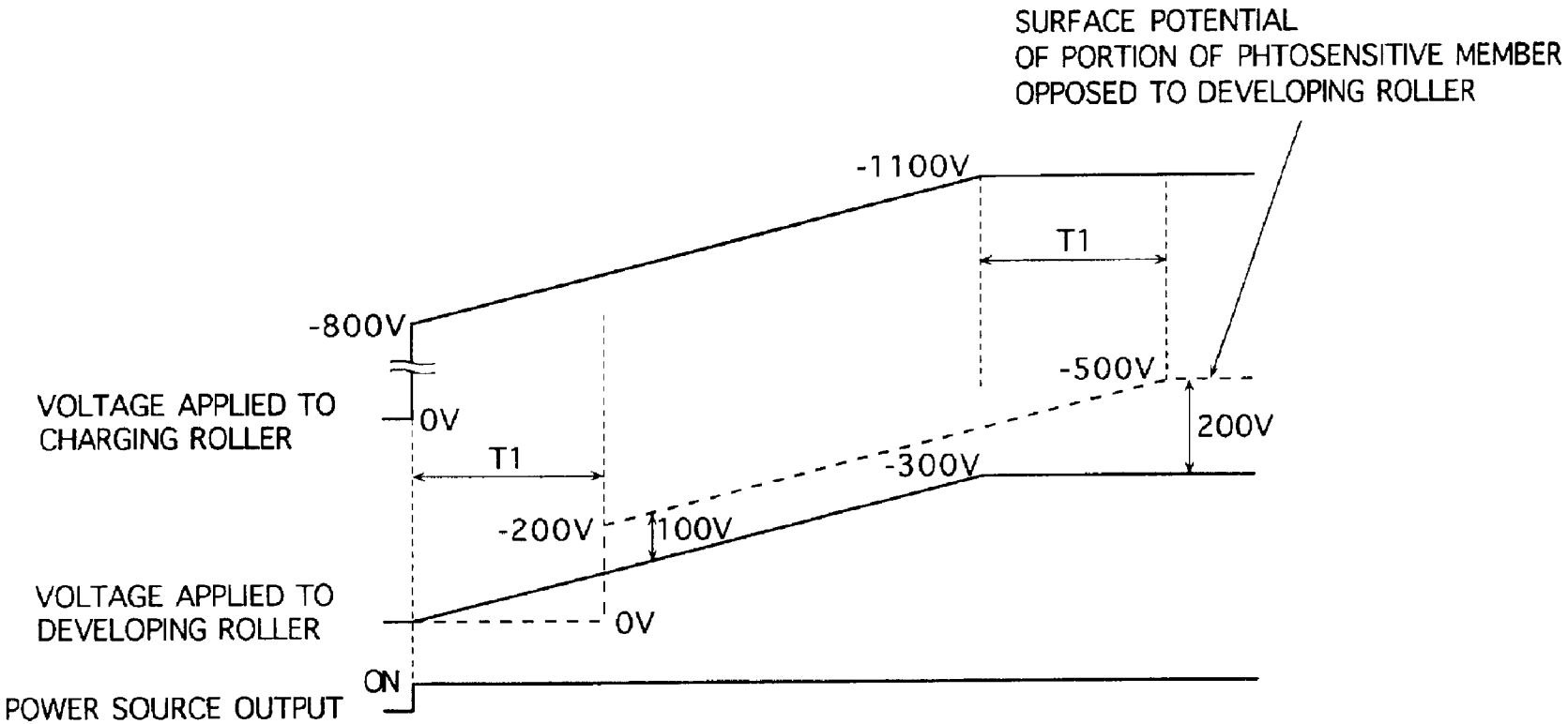
FIG. 9 illustrate still another example of raising of voltages applied to the charging and developing rollers.
Figure 10:
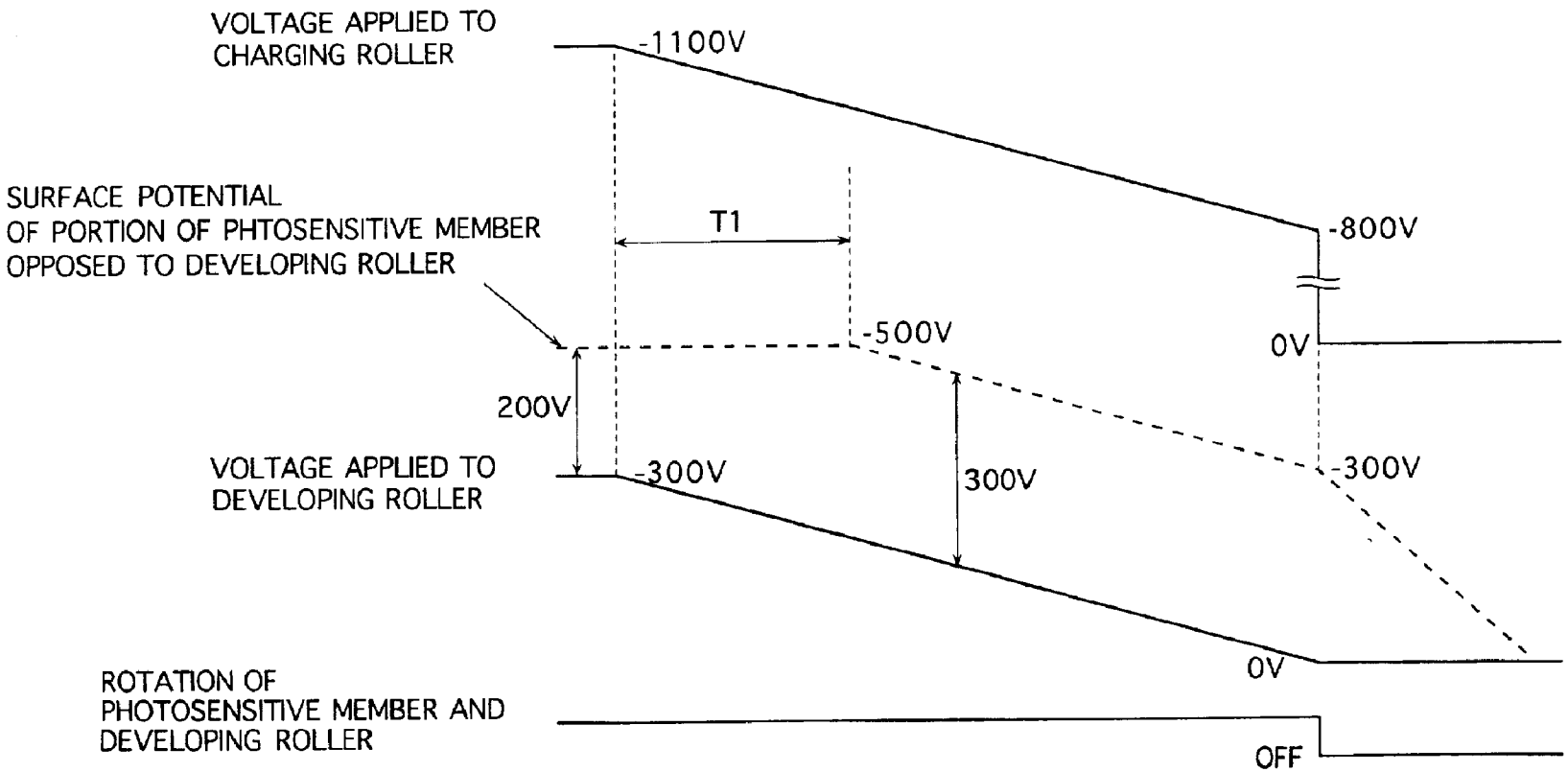
FIG. 10 illustrate yet another example of lowering of the voltages applied to the charging and developing rollers.

The raising and lowering in the above image forming apparatus are illustrated by way of example in FIGS. 9 and 10, respectively.

As illustrated in FIG. 9, when the controller 10 issues a print start instruction, the photosensitive member 1 starts the rotation to prepare for printing.

In accordance with the instruction of the control portion 9, the power source 8 starts to apply the voltages to the charging and developing rollers 2 and 31, and the voltages of the initial values of −800 V and 0V are applied to the charging and developing rollers 2 and 31, respectively. From these initial values, the voltages applied to the charging and developing rollers 2 and 31 are continuously changed toward the voltages of −1100 V and −300 V, i.e., of the values for the practical use in the image formation, respectively.

The voltage applied to the developing roller 31 from the common power source 8 via the Zener diode D1 changes while keeping a potential difference of 800 V with respect to the voltage applied to the charging roller 2. The portion of the photosensitive member 1 opposed to the developing roller 31 bear the surface potential of 0 V before the region of the photosensitive member 1 charged by the charging roller 2 opposed thereto reaches the developing position in accordance with the rotation of the photosensitive member 1, and the developing potential difference is kept in a range from 0 V to 100 V so that the developer does not move onto the photosensitive member 1.

When the time equal to the time t1 elapses after the start of power supply to the charging and developing rollers 2 and 31, the surface potential of the portion of the photosensitive member 1 opposed to the developing roller 31 continuously changes from the initial value of −200 V toward the value of −500 V for the practical use in the image formation in accordance with the voltage applied to the charging roller 2. During this, the electric field in the non-developing direction is formed with respect to the developing roller 31 by the potential difference of 100 V–200 V, and the developer does not move onto the photosensitive member 1.

When the surface potential of the photosensitive member 1 reaches the value of −500 V for the image formation, the preparing operation ends, and then the image forming operation starts.

The difference between the voltages applied to the charging and developing rollers 2 and 31 is not restricted to 800 V, and may be set to another value depending on the image formation process.

After the image forming operation is completed, the ending operation starts.

As shown in FIG. 10, the voltages applied to the charging and developing rollers 2 and 31 are continuously changed from −1100 V and −300 V, i.e., the values for practical use in the image formation toward −800 V and 0V, respectively. During the above change, the difference of 800 V is kept between the voltages, which are applied from the common power source 8 to the charging roller 2 and through the Zener diode D1 to the developing roller 31, respectively. The surface potential of the portion of the photosensitive member 1 opposed to the developing roller 31 likewise changes continuously in accordance with the voltage applied to the charging roller 2.

During this, the potential difference of 200 V–300 V is present between the surface potential of the portion of the photosensitive member 1 opposed to the developing roller 31 and the voltage applied to the developing roller 31, and forms the electric field in the non-developing direction so that the developer does not move onto the photosensitive member 1.

After the portion of the photosensitive member 1 opposed to the developing roller 31 reaches the surface potential of −300 V, the power source 8 stops the output, and the photosensitive member 1 and the developing roller 31 stop the rotation.

In the operation of continuously changing the applied voltages for raising and lowering, the potential difference to be kept between the voltages applied to the charging and developing rollers 2 and 31 is not restricted to the foregoing value of 800 V. This potential difference may be set to another value in accordance with the image forming process.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus having an electrostatic latent image carrier, a charging device and a developing device for forming an image by charging a surface of said electrostatic latent image carrier by said charging device, to which a charging voltage is applied, effecting image exposure on a charged region of the surface of said electrostatic latent image carrier to form an electrostatic latent image, and developing the electrostatic latent image by said developing device, to which a developing bias voltage is applied, and comprising:

an output variable power source common to said charging device and said developing device for applying the charging voltage to said charging device and applying the developing bias voltage to said developing device;

a power source output control portion for controlling an output of said power source; and a voltage changing device interposed between said charging device and said power source and/or between said developing device and said power source, wherein when the voltages applied to said charging and developing devices are raised to voltages required for image formation, respectively, said power source output control portion controls the output of said power source to perform the raising of said applied voltages for a predetermined time while keeping a potential difference for suppressing movement of developer onto said electrostatic latent image carrier between said voltages applied to said charging and developing devices, and wherein said voltage changing device can perform voltage transformation in two or more steps, and said power source output control portion controls the output of said power source for raising said applied voltages, while controlling an output of said voltage changing device to suppress movement of the developer to said electrostatic latent image carrier.

2. The image forming apparatus according to claim 1, wherein when the voltages applied to said charging and developing devices are lowered after completion of an image forming operation, full exposure is effected on the surface of said electrostatic latent image carrier, and said electrostatic latent image carrier and said developing device are stopped simultaneously with or after arrival of the fully exposed surface portion of said electrostatic latent image carrier at a developing position opposed to said developing device.

3. The image forming apparatus according to claim 1, wherein when raising said voltages applied to said charging and developing devices, said power source output control portion changes stepwise the output of said power source at time intervals each equal to or longer than a time required for moving the charged region of said electrostatic latent image carrier surface charged by said charging device to a developing position opposed to said developing device.

4. An image forming apparatus having an electrostatic latent image carrier, a charging device and a developing device for forming an image by charging a surface of said electrostatic latent image carrier by said charging device, to which a charging voltage is applied, effecting image exposure on a charade region of the surface of said electrostatic latent image carrier to form an electrostatic latent image, and developing the electrostatic latent image by said developing device to which a developing bias voltage is applied, and comprising:

an output variable power source common to said charting device and said developing device for applying the charging voltage to said charging device and applying the developing bias voltage to said developing device;

a power source output control portion for controlling an output of said power source; and a voltage changing device interposed between said charging device and said power source and/or between said developing device and said power source, wherein when the voltages applied to said charging and developing devices are lowered from voltages reguired for image formation, respectively, said power source output control portion controls the output of said power source to perform the lowering of said applied voltages for a predetermined time while keeping a potential difference for suppressing movement of developer onto said electrostatic latent image carrier between said voltages applied to said charging and developing devices, and wherein when lowering said voltages applied to said charging and developing devices, said power source output control portion changes stepwise the output of said power source at time intervals each equal to or longer than a time required for moving the charged region of said electrostatic latent image carrier surface charged by said charging device to a developing position opposed to said developing device.

5. An image forming apparatus having an electrostatic latent image carrier, a going device, a developing device and an image exposing device for forming an image by charging a surface of said electrostatic latent image carrier by said charging device, to which a charging voltage is applied, effecting image exposure by said image exposing device on a charged region of the surface of said electrostatic latent image carrier to form an electrostatic latent image, and developing said electrostatic latent image by said developing device, to which a developing bias voltage is applied, and comprising:

an output variable power source common to said charging device and said developing device for applying the charging voltage to said charging device and applying the developing bias voltage to said developing device;

a power source output control portion for controlling an output of said power source; and a voltage changing device interposed between said charging device and said power source and/or between said developing device and said power source, wherein when the voltages applied to said charging and developing devices are lowered after completion of an image forming operation, said image exposing device effects full exposure on the surface of said electrostatic latent image carrier, said power source output control portion stops the output from said power source simultaneously with arrival of the fully exposed surface portion of said electrostatic latent image carrier at a developing position opposed to said developing device, and said electrostatic latent image carrier stops simultaneously with said arrival, or after said arrival and before said fully exposed surface portion completely passes through said developing position.

* * * * *